US005462005A

United States Patent [19]

Finger

[11] Patent Number: 5,462,005

[45] Date of Patent: Oct. 31, 1995

[54] METHOD AND APPARATUS FOR RESERVING SEATS AT ENTERTAINMENT EVENT

[76] Inventor: Edward J. Finger, 7696 E. El Rancho, Scottsdale, Ariz. 85260

[21] Appl. No.: 161,597

[22] Filed: Dec. 6, 1993

[51] Int. Cl.[6] ..... G09F 7/20

[52] U.S. Cl. ..... 116/200; 40/320

[58] Field of Search ..... 116/30, 200; 40/320; 242/77, 96; 256/1

[56] References Cited

U.S. PATENT DOCUMENTS 3,283,433 11/1966 Navarino ..... 40/320
3,688,440 9/1972 Applegarth et al. ..... 256/1
4,852,822 8/1989 Brady ..... 242/77
4,858,551 8/1989 Peters ..... 116/30
5,050,846 9/1991 Goodman et al. ..... 256/1

*Primary Examiner*—Diego F. F. Gutierrez
*Assistant Examiner*—Willie Morris Worth
*Attorney, Agent, or Firm*—Tod R. Nissle

[57] ABSTRACT

Apparatus for reserving a seat in an entertainment theater includes a casing and a tape which is extendable from and retractable into the casing. The casing and tape are looped over the armrests of seats to reserve the seats. Indicia on the tape denote that the seats over which the tape is extended are reserved.

6 Claims, 3 Drawing Sheets

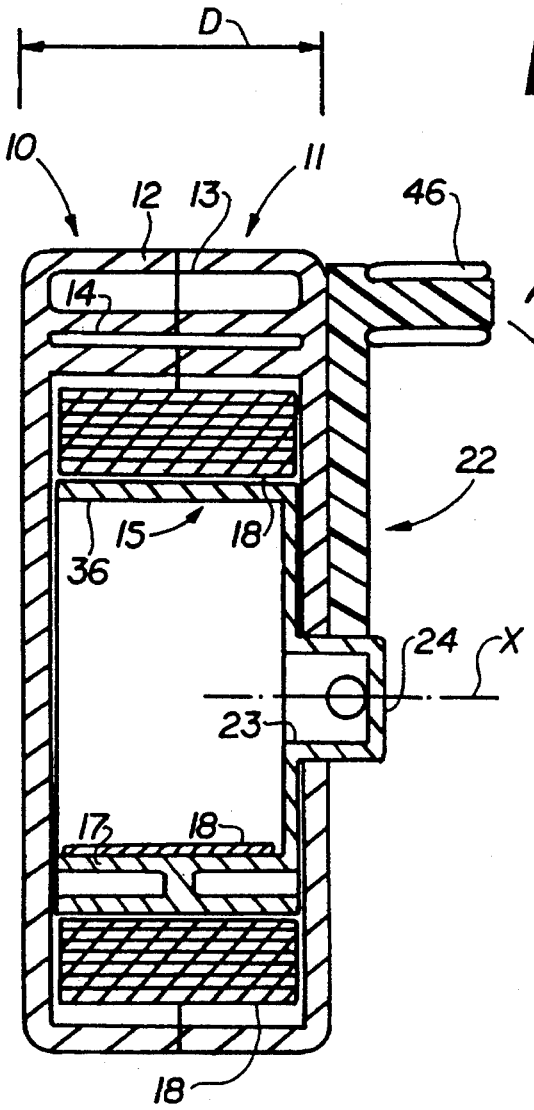
FIG. 5
FIG. 6
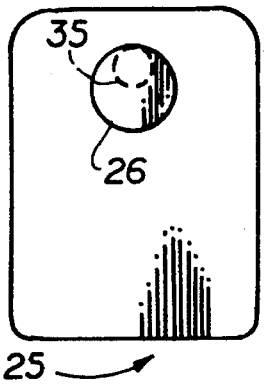
FIG. 7
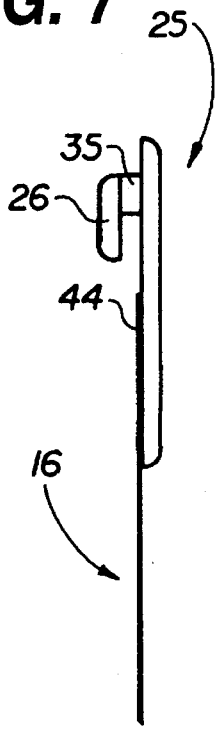
FIG. 8
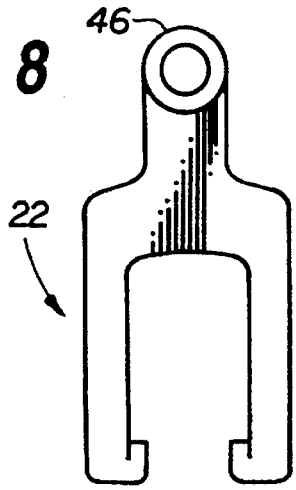

METHOD AND APPARATUS FOR RESERVING SEATS AT ENTERTAINMENT EVENT

This invention relates to an apparatus and method for reserving a seat in an entertainment theater.

More particularly, the invention relates to apparatus which can be concealed on the person and can be used to reserve seats at an entertainment event.

When an individual attends a movie or other entertainment event, he often, after the seat is selected, leaves the seat temporarily to obtain refreshments or for some other purpose. Reserving the seat while it is temporarily vacated is often awkward, both because other individuals sitting next to the seat must continually advise other theater goers who are looking for a seat that the seat is taken and because it is risky to leave behind a jacket or other personal belonging on the seat to indicate that the seat is taken.

Accordingly, it would be highly desirable to provide a simple method and apparatus for a theater goer to reserve his or her seat when the seat is temporarily vacated.

Therefore, it is a principal object of the invention to provide an improved method and apparatus for reserving a seat in a movie theater or at another entertainment event.

A further object of the invention is to provide an improved apparatus for reserving a theater seat which minimizes the risk that another party will damage or remove the apparatus.

Another object of the invention is to provide an improved apparatus for reserving a theater seat which can be concealed on the person.

Still a further object of the invention is to provide an improved apparatus for reserving a theater seat which, in use, minimizes the risk of damage to the theater seat.

Yet another object of the invention is to provide an improved apparatus for reserving a theater seat which is readily adapted for use with different sized theater seats and which can be utilized to reserve more than one theater seat at a time.

These and other, further and more specific objects and advantages of the invention will be apparent to those skilled in the art from the following detailed description thereof, taken in conjunction with the drawings, in which:

FIG. 5 is a section view of the tape unit of FIG. 2 illustrating internal construction details thereof;

FIG. 6 is a top view illustrating a latch plate used in the tape of FIG. 2;

FIG. 7 is a side view illustrating the latch plate of FIG. 6; and,

FIG. 8 is a front view illustrating the crank of the tape of FIG. 2.

Briefly, in accordance with my invention, I provide a tape unit for reserving seats at an entertainment event. The tape unit includes a casing; an attached tape extendable from and retractable into the casing to form a coil therein and having a distal end; indicia on the tape denoting that seats over which the tape is extended are reserved; means for looping the distal end around a first seat armrest; and, means for securing the casing to a second seat armrest.

In another embodiment of the invention, I provide a method for reserving seats at an entertainment event. The method includes the step of providing a tape unit. The tape unit includes a casing; an attached tape extendable from and retractable into the casing to form a coil therein and having a distal end; indicia on the tape denoting that seats over which the tape is extended are reserved; means for looping the distal end around a first seat armrest; and, means for securing the casing to a second seat armrest. The tape is extended from the casing and the distal end is looped around a first armrest such that the indicia are visible to an individual looking for a seat. The casing is secured to a second armrest.

Figure 1:
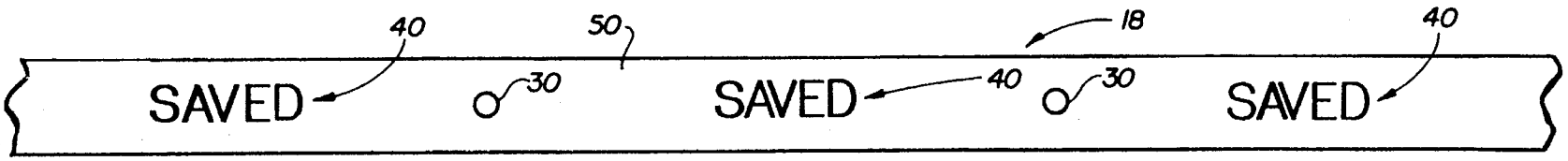
FIG. 1 is a top view illustrating a tape utilized in the presently preferred embodiment of the invention.

Turning now to the drawings, which depict the presently preferred embodiment of the invention for the purpose of illustrating the practice thereof and not by way of limitation of the scope of the invention, and in which like reference characters refer to corresponding elements throughout the several views, FIG. 1 illustrates a tape 18 with indicia 40 inscribed thereon at selected equal intervals therealong and with apertures 30 formed at equal intervals along the tape 18 intermediate adjacent pairs of indicia 40. Indicia 40 denote to a viewer that seats over which tape 18 extends are reserved. Tape 18 is incorporated in the tape unit illustrated in FIGS. 2 to 5.

Figure 2:
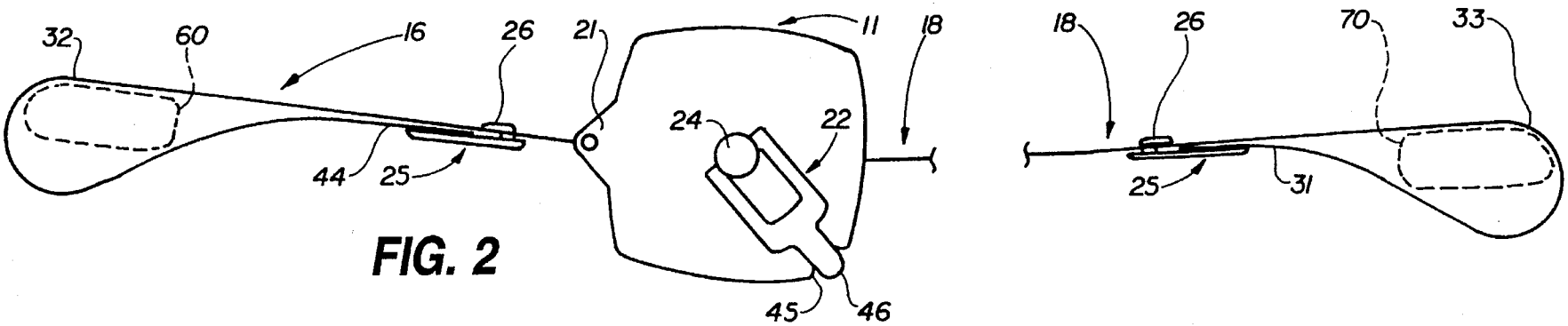
FIG. 2 is a side elevation view illustrating a tape unit constructed in accordance with the principles of the invention.
Figure 3:
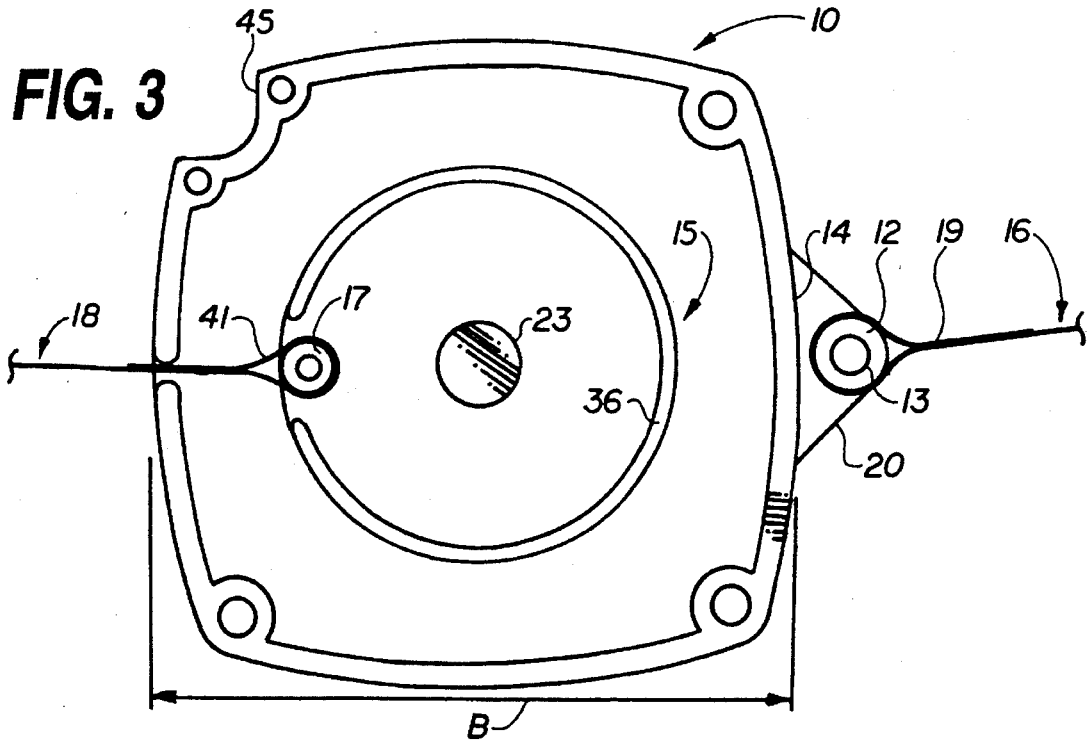
FIG. 3 is a front view illustrating one half of the casing of the tape unit of FIG. 2.
Figure 4:
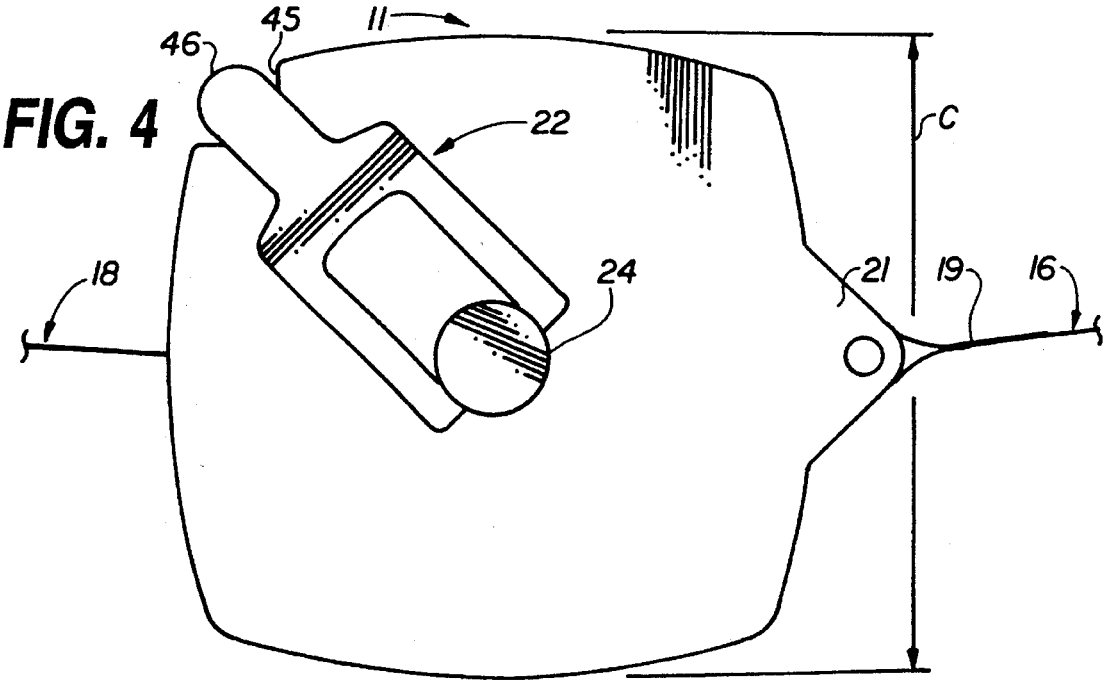
FIG. 4 is a back view illustrating the other half of the casing of the tape unit of FIG. 2.

The tape unit of FIGS. 2 to 5 includes a casing comprised of a pair of facing halves 10 and 11 (FIG. 5). The casing is presently preferably about two inch square and houses a spool 15. The dimensions indicated by arrows B and C in FIGS. 3 and 4 are each about two inches. The dimension indicated by arrows D in FIG. 5 is presently slightly less than one inch. Consequently, the tape unit is readily concealed on the person.

Spool 15 includes a cylindrical lip 36 and a hollow neck 24 which is rotatably seated in and extends through casing half 11 in the manner illustrated in FIG. 5. Crank 22 is pivotally attached to neck 24. Cylindrical opening 23 extends into neck 24.

Half 11 (FIG. 4) includes triangular projection 21 which is spaced apart and opposes triangular projection 20 on casing half 10 (FIG. 3). Cylindrical member 12 extends between projections 20 and 21. Aperture 13 extends through member 12. The proximate end 19 of tape 16 is fixedly secured to member 12 and loops around member 12 and through slot 14 back onto itself in the manner shown in FIG. 3. The distal end 44 of tape 16 is fixedly attached to a first pad 25 which includes a hook 26 attached to pad 25 by arm 35. Hook 26 is shaped to extend through and engage an aperture 30 formed through tape 16. A plurality of spaced apart apertures 30 are formed through tape 16 in the same manner that spaced apart apertures 30 are formed through tape 18.

The proximate end 41 of tape 18 is permanently attached to spool 15 and wraps around cylindrical member 17 of spool 15 back onto itself in the manner illustrated in FIG. 3. The distal end 31 of tape 18 is fixedly attached to a second pad 25 which includes a hook 26 attached to pad 25 by arm 35. Hook 26 of the pad on the distal end 31 of tape 18 is shaped to extend through and engage any one of the apertures 30 formed through tape 18.

Tape 18 can be manually pulled out of the casing and away from the tape unit of FIG. 2 in conventional fashion. When crank 22 is in the position shown in FIG. 5, it can freewheel when tape 18 is pulled out of the tape unit off of spool 15 and can be rotated about axis X to turn spool 15 and wind tape 18 back onto spool 15. When crank 22 is pivoted about neck 24 in the direction of arrow A in FIG. 5, handle 46 of crank 22 can be moved or snapped into the position shown in FIGS. 2 and 4 and interlock with ingress or groove 45 formed in one corner of the casing of the tape unit. When handle 46 is in the position shown in FIGS. 2 and 4, crank 22 and spool 15 will not turn and tape 18 is prevented from moving into or out of the casing of the tape unit.

In use, crank 22 is placed in the position shown in FIG. 5 and is turned to wind tape 18 into the casing onto spool 15. In FIG. 5, the tape 18 is wound onto spool 15. Crank 22 is then placed in the storage or locking position shown in FIGS. 2 and 4 with handle 46 snapped into groove 45. The tape unit is then concealed on the person of the user. The user is at home or some other location remote from the movie theater or other entertainment event to which the user is traveling. The user travels to the entertainment event and removes the tape unit from his person. Crank 22 is moved to the position shown in FIG. 5. The distal end 44 of tape 16 is looped around the armrest of a seat and hook 26 is inserted through an aperture 30 in tape 16 in the manner illustrated in FIG. 2 to form loop 32. Tape 18 is pulled out of the casing of the tape unit the desired length of tape 18 extends out of the casing. Spool 15 and crank 22 freewheel while tape 18 is pulled out of the casing. Crank 22 is pivoted about neck 24 to place handle 46 into groove 45 and lock spool 15 in fixed position. The distal end 31 of tape 18 is looped around another seat armrest to form loop 33 and hook 26 on pad 25 on distal end 31 is inserted through an aperture 30 in tape 18 in the manner illustrated in FIG. 2. Since a plurality of holes are formed in tape 18, the size of loop 33 can be varied such that the tapes 16 and 18 are sufficiently taut, are substantially horizontal, and do not droop excessively toward the ground. After loops 32 and 33 are formed and tapes 16 and 18 extend between a selected pair of armrests 60, 70 in a selected row of seats, face 50 is horizontally oriented and the "SAVED" indicia 40 faces upwardly away from the ground such that other theater patrons can readily see the indicia 40 and realize that the seats over which tapes 16 and 18 extend are reserved. If desired, the armrests about which loops 32 and 33 can be the armrests for a single seat. Or, loop 32 can extend around the left arm armrest of a first seat and loop 33 can extend around the right arm armrest of a second seat immediately adjacent, in the same row as, and to the right of the first seat. Consequently, the tape unit of the invention can be utilized to reserve one or more seats in a row of side-by-side chairs.

If desired, adhesive tape or any other fastening means can be utilized in place of or in combination with loops 32 and 33 to fasten the distal ends 44 and 31 of tapes 16 and 18 to the armrests of the seats in a row such that tapes 16 and 18 extend above or along and on the seats with the tapes 16 and 18 horizontally oriented and face 50 and indicia 40 facing upwardly for viewing by other individuals looking for seats in a theater or other entertainment forum. The tape unit of the invention can, if desired, be secured to chairs with tapes 16 and 18 oriented such that face 50 is vertically oriented and indicia 40 face toward or away from the upright backs of the seats. Indicia 40 can be formed on both sides of tape 16, 18.

FIGS. 6 and 7 further illustrate pad 25. FIG. 8 is an elevation view of crank 22.

Having described my invention in such terms as to enable those skilled in the art to understand and practice it, and having described the presently preferred embodiments thereof,

I claim:

1. A tape unit for reserving a plurality of seats at an entertainment event, said tape unit including (a) a hollow casing;

(b) a tape having a distal end and a proximate end;

(c) spool means for supporting said tape when said tape is coiled, said spool means mounted within said casing and attached to said proximate end of said tape;

(d) means for retracting said tape into said casing and winding said tape in a coil upon to said spool means;

(e) indicia on said tape denoting that seats over which said tape is extended are reserved;

(f) means for looping said distal end around a first seat armrest; and, (g) means for securing said casing to a second seat armrest such that said tape is horizontally oriented and extends over a plurality of seats, said tape unit being shaped and dimensioned to be carried on a person.

2. A method for reserving a plurality of seats at an entertainment event, comprising the steps of (a) providing a tape unit comprising (i) a hollow casing, (ii) a tape having a distal end and a proximate end, (iii) spool means for supporting said tape when said tape is coiled, said spool means mounted within said casing and attached to said proximate end of said tape, (iv) means for retracting said tape into said casing and winding said tape in a coil upon said spool means, (v) indicia on said tape denoting that seats over which said tape is extended are reserved, (vi) means for looping said distal end around a first seat armrest, and, (vii) means for securing said casing to a second seat armrest, said tape unit being shaped and dimensioned to be carried on a person;

(b) extending said tape from said casing;

(c) looping said distal end of said tape around a first armrest such that said indicia are visible to an individual looking for a seat;

(d) securing said casing to a second seat armrest such that said tape is horizontally oriented and extends over a plurality of seats.

3. A tape unit for reserving seats at an entertainment event, said tape unit including (a) a hollow casing;

(b) a tape having a distal end and a proximate end;

(c) spool means for supporting said tape when said tape is coiled, said spool means mounted within said casing and attached to said proximate end of said tape;

(d) means for retracting said tape into said casing and winding said tape in a coil upon said spool means;

(e) indicia on said tape denoting that seats over which said tape is extended are reserved;

(f) fastener means for securing said distal end to said tape after said distal end is looped around a first seat armrest; and, (g) means for securing said casing to a second seat armrest such that said tape is horizontally oriented and extends over and is spaced apart from a plurality of seats;

said tape unit being shaped and dimensioned to be carried on a person.

4. The tape unit of claim 3 wherein said fastener means permits varying the size of loop formed by looping said distal end around said first seat armrest, said fastener means comprising (a) a plurality of spaced apart openings formed along said tape; and, (b) means on said distal end to removably engage one of said openings at a time.

5. The tape unit of claim 4 wherein said means for securing said casing to said second seat arm rest comprises a loop attached to said casing and shaped to fit around said second arm rest.

6. The tape unit of claim 5 wherein said means for securing said casing to said second arm rest comprises a pliable elongate piece of material including (a) a first end attached to said casing;

(b) a second end;

(c) a plurality of opening formed in said pliable piece of material; and, (d) means on said second end shaped to removably engage one of said openings at a time.

* * * * *